US005430940A

United States Patent [19]

Lym

[11] Patent Number: 5,430,940

[45] Date of Patent: Jul. 11, 1995

[54] SCISSORS COMBINED WITH A CUTTER KNIFE

[76] Inventor: Sungdae Lym, Dabok Villa 301, 257-203, Enum 2-Dong, Dongdaemun-Ku, Seoul, Rep. of Korea

[21] Appl. No.: 183,650

[22] Filed: Jan. 19, 1994

[30] Foreign Application Priority Data

Jul. 23, 1993 [KR] Rep. of Korea ..... 93-13765
Jul. 23, 1993 [KR] Rep. of Korea ..... 93-13766

[51] Int. Cl.[6] ..... B25F 3/00

[52] U.S. Cl. ..... 30/146; 30/142

[58] Field of Search ..... 30/146, 142, 131, 123, 30/162, 194, 225, 335

[56] References Cited

U.S. PATENT DOCUMENTS 6,089 10/1874 Johnson ..... 30/146
146,457 1/1874 Johnson ..... 30/146
392,395 11/1888 Askey ..... 30/146
1,201,872 10/1916 Richel ..... 30/146
4,792,692 1/1989 Wang ..... 30/146 X
4,914,820 4/1990 Saito .
5,086,563 2/1992 Sakuma et al. .
5,171,256 12/1992 Smith et al. .
5,203,785 4/1993 Slater .
5,279,034 1/1994 Smith et al. .

*Primary Examiner*—Douglas D. Watts
*Attorney, Agent, or Firm*—Lowe, Price, LeBlanc & Becker

[57] ABSTRACT

The present invention relates to scissors combined with a cutter knife. Since scissors and a cutter knife are connected together, a user can easily and conveniently change cutting instruments from scissors to a cutter knife or vice versa depending on his need, in addition to a convenient, easy and simultaneous keeping of both scissors and the cutter knife for later use.

7 Claims, 10 Drawing Sheets

SCISSORS COMBINED WITH A CUTTER KNIFE

BACKGROUND OF THE INVENTION

1. Field of the Invention

The present invention relates to scissors, more particularly to scissors combined with a cutter knife.

2. Description of the Prior Art

In general, scissors and a cutter knife have been separately used when cutting papers or sewing at home.

Users usually change cutting instruments from scissors to a cutter knife or vice versa, depending on his need.

Therefore, there exist problems in that it is inconvenient for a user to change cutting instruments and separately purchase both scissors and a cutter knife.

SUMMARY OF THE INVENTION

It is an object of the present invention to provide scissors combined with a cutter knife. The scissors combined with a cutter knife according to the present invention are constructed by combining a cutter knife having a replaceable blade on one side of scissors' blades.

Accordingly, users can easily and conveniently change cutting instruments from scissors to a cutter knife or vice versa depending on his work.

Therefore, it is easy to keep both scissors and a cutter knife for a later use and to save the trouble of changing the cutting instruments.

DESCRIPTION OF THE PREFERRED EMBODIMENTS

Figure 1:
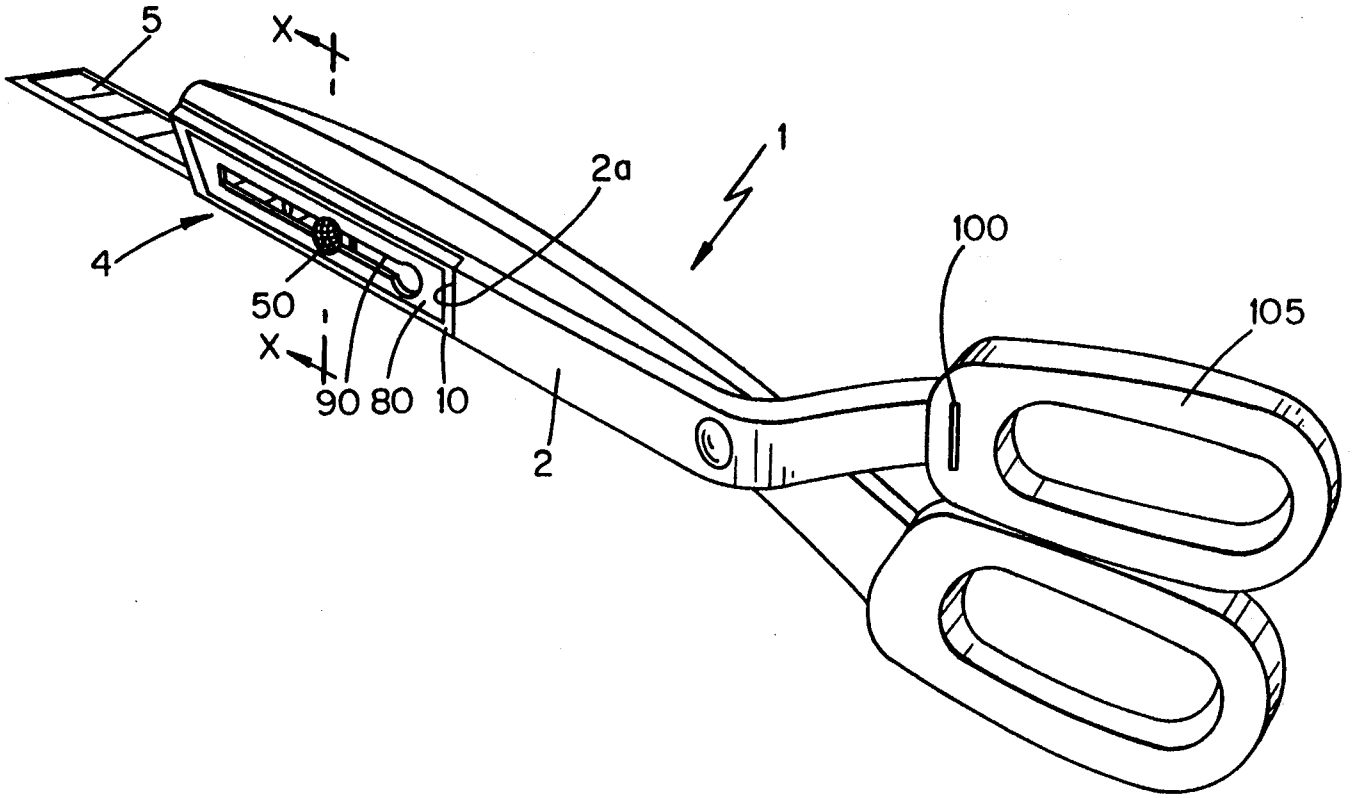
FIG. 1 is a perspective view showing the first embodiment of scissors combined with a cutter knife according to the present invention.
Figure 2:
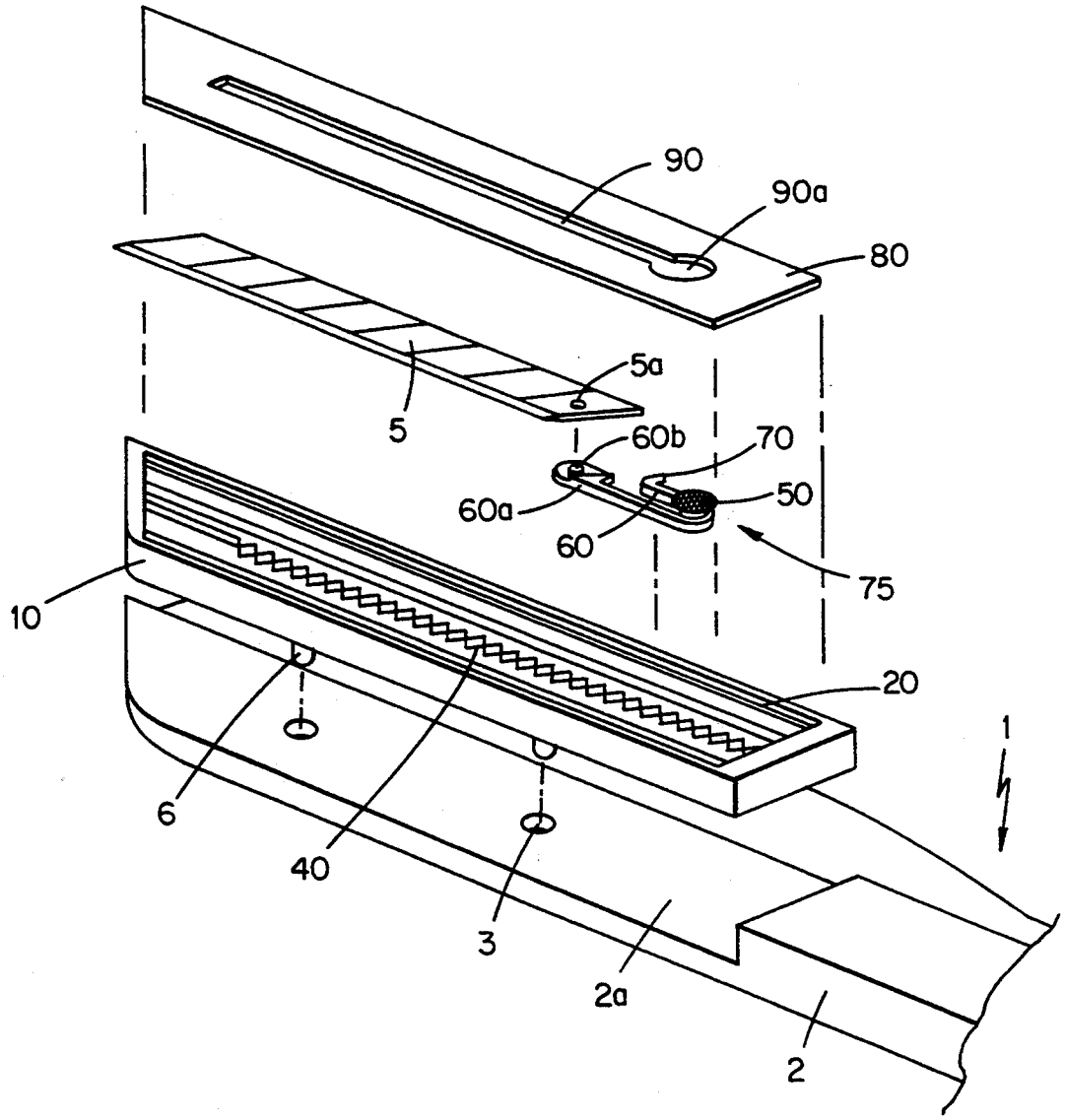
FIG. 2 is an exploded perspective view of a cutter knife shown in FIG. 1.
Figure 3:
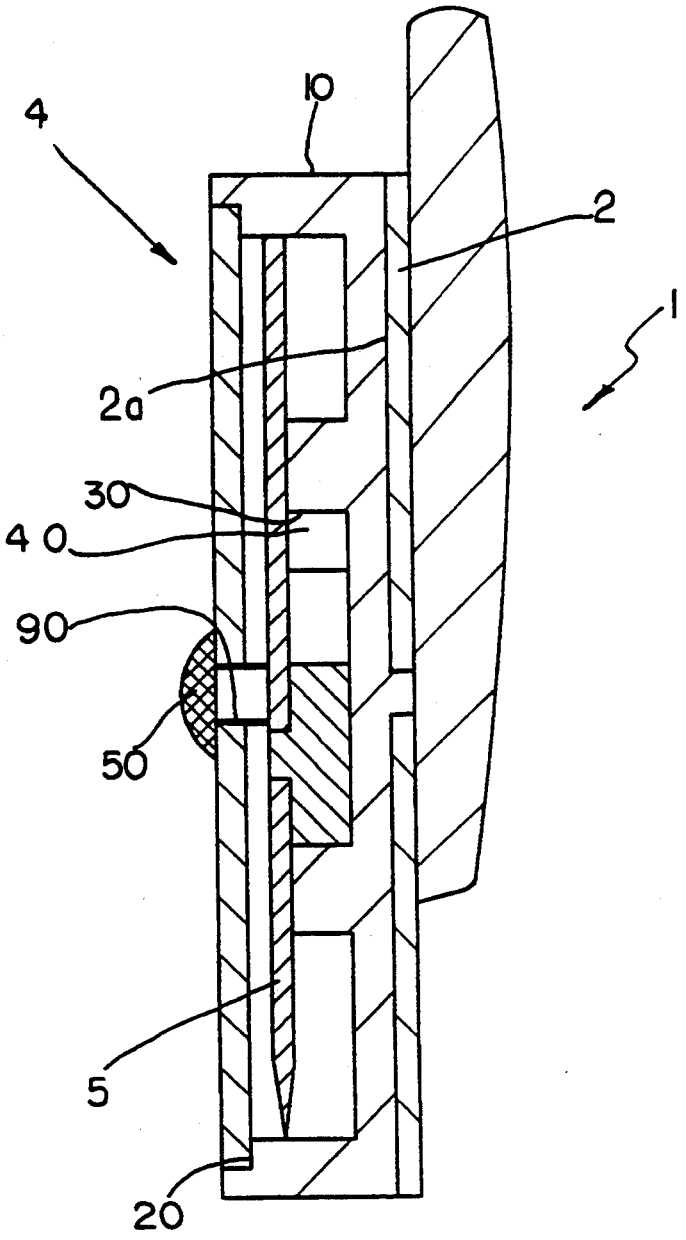
FIG. 3 is an enlarged cross-sectional view taken along the line X—X in FIG. 1.

FIG. 1 to FIG. 3 are views for the first embodiment of scissors combined with a cutter knife according to the present invention. As shown in FIG. 1 to FIG. 3, the first embodiment according to the present invention is constructed with scissors 1 and a cutter knife 4 combined with one of the blades 2 of the scissors 1.

A seat portion 2*a* is formed on one of the scissors' blades 2 in order to provide room for the cutter knife 4 to be fixed on, and two connection holes 3 are also provided in the seat portion 2*a* in place for connection with the cutter knife 4. And also, the cutter knife 4 is constituted with an upper plate 80 having a longitudinal slot 90 whose one end is formed in a somewhat enlarged hole 90*a*; a blade 5 having a hole 5*a* nearly at the end;

a knife case 10 having two insertion protrusions 6 protruded from the back of the case 10, a pair of longitudinal upper plate fixing portions 20 formed in parallel to each other, a pair of longitudinally protruded inside walls 30 formed in parallel to each other, and a longitudinal teeth-like convex-o-concave portion 40 formed on one of the inside walls 30; and a slider 75 constructed by an elastic portion 60 having a clicker 70, a guidance portion 60*a* having an insertion protrusion 60*b*, and a slider knob 50.

The blade 5 is put on the walls 30 formed inside the knife case 10 following a connection of the hole 5*a* of the blade 5 with the insertion protrusion 60*b* of the slider 75. And also, the upper plate 80 is placed on the upper plate fixing portions 20 of the knife case 10.

At this time, the slider knob 50 of the slider 75 is protruded out through the enlarged hole 90*a* formed at the end of the longitudinal slot 90. The width of the upper plate 80 is somewhat longer than that of a pair of the upper plate fixing portions 20 and the upper plate 80 is manufactured by a thin plate which is elastically flexible, so that the upper plate 80 can be easily inserted and fixed on the upper plate fixing portions 20 by exerting pressure on the upper plate 80.

The cutter knife 4 having an aforementioned construction is combined with scissors 1 through a connection of the insertion protrusions 6 protruded from the back of the knife case 10 with the connection holes 3 formed in the seat portion 2*a* of the scissors' blade 2.

At this time, an adhesive agent is applied on the seat portion 2*a* and the back of the knife case 10 for a firm fixture.

Usage of the scissors combined with a cutter knife will be described below. That is, the blade 5 of the cutter knife 4 comes into or out of the knife case 10 when pushing the slide knob 50 of the cutter knife 4 forwards or backwards.

At this time, the clicker 70 of the elastic portion 60 moves when pushing the slide knob 50 of the slider 75 forwards or backwards, the clicker 70 of the elastic portion 60 moves forwards or backwards along the longitudinal teeth-like convex-o-concave portion formed on one of the walls 30, so that the blade 5 connected with the slider 75 comes out of or into the knife case 10. With removal of the pushing when the blade 5 has come out of the knife case 10 in a suitable length for use, the clicker 70 is captured in the convex-o-concave portion 40 by a restoring force of the elastic portion 60, thereby preventing the blade 5 from moving during its use.

The convex-o-concave portion 40 is formed on one of the walls 30 in order to prevent the upper plate 80 from being detached from the upper plate fixing portions 20 by a force exerted on the upper plate 80 during the use of the cutter knife 4.

And also, the upper plate 80, which is a thin plate, can be detached from the upper plate fixing portions 20 when a force is applied on one side of the upper plate 80 to such an extent that the upper plate 80 is bent. And then, the blade 5 and the slider 75 can be taken out of the knife case 10 for being substituted for the blade 5.

Assembling the cutter knife 4 can be done in an aforementioned manner.

Figure 4:
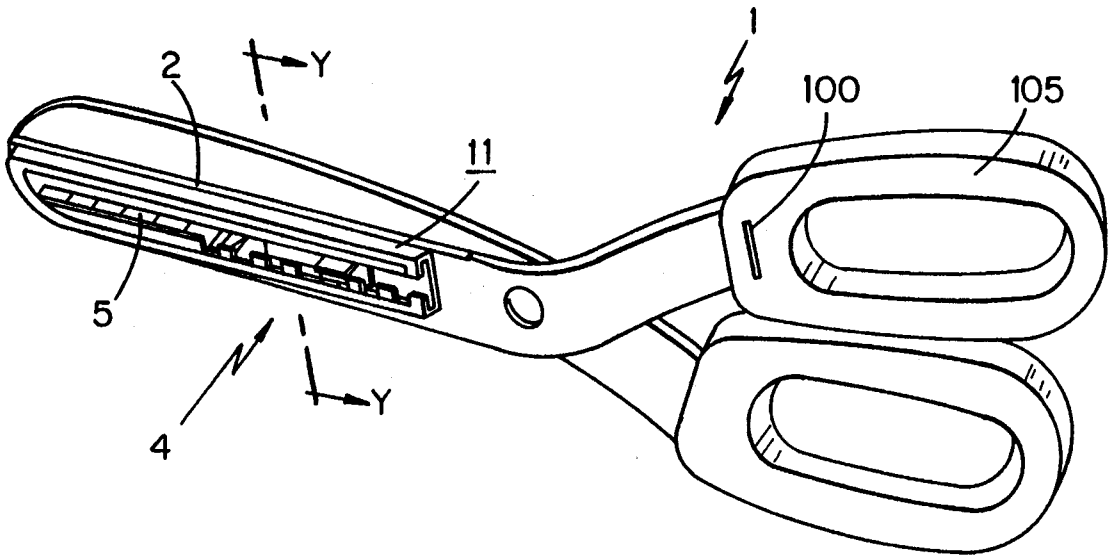
FIG. 4 is a perspective view showing the second embodiment of scissors combined with a cutter knife according to the present invention.
Figure 5:
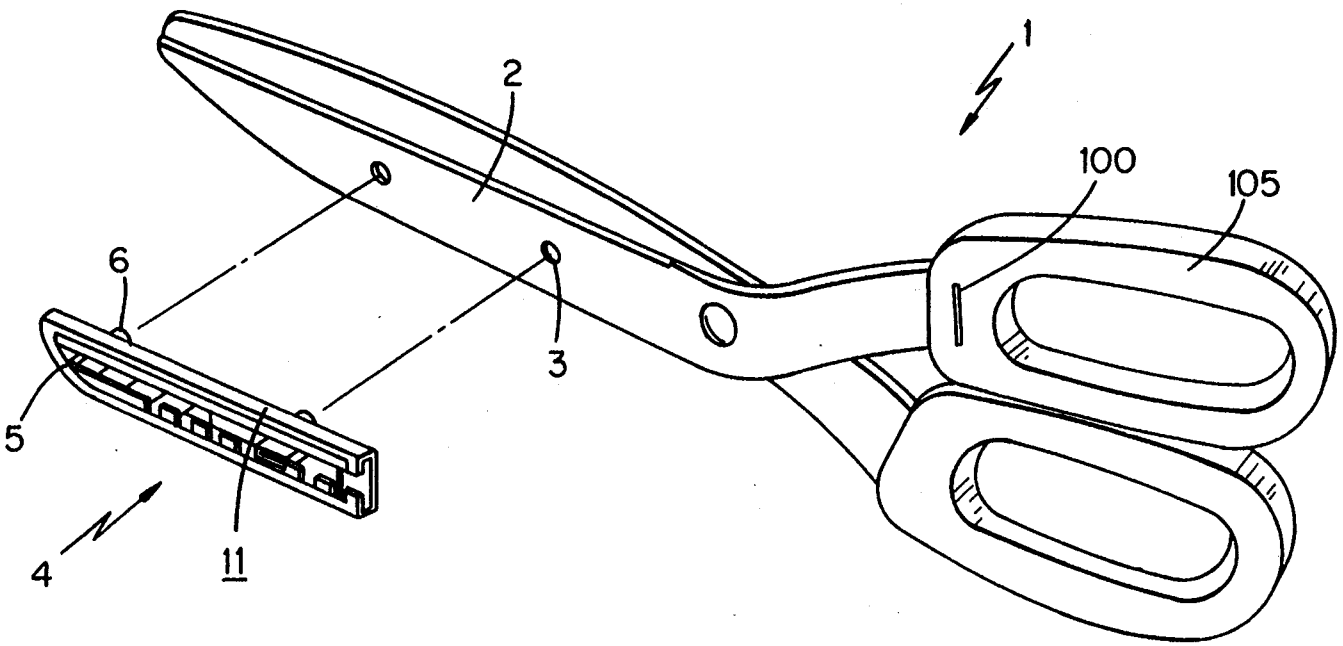
FIG. 5 is an exploded perspective view of scissors and a cutter knife shown in FIG. 4.
Figure 6:
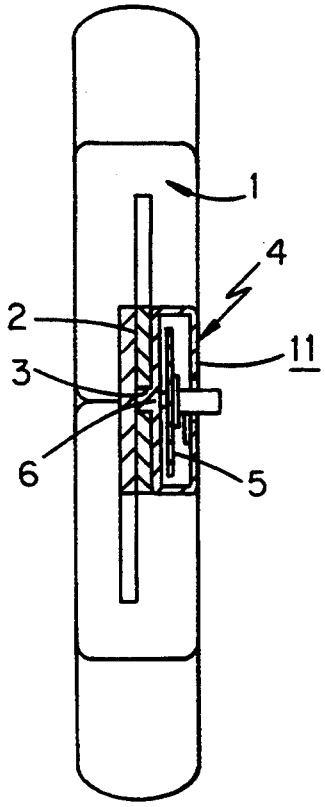
FIG. 6 is an enlarged cross-sectional view taken along the line Y—Y in FIG. 4.
Figure 7:
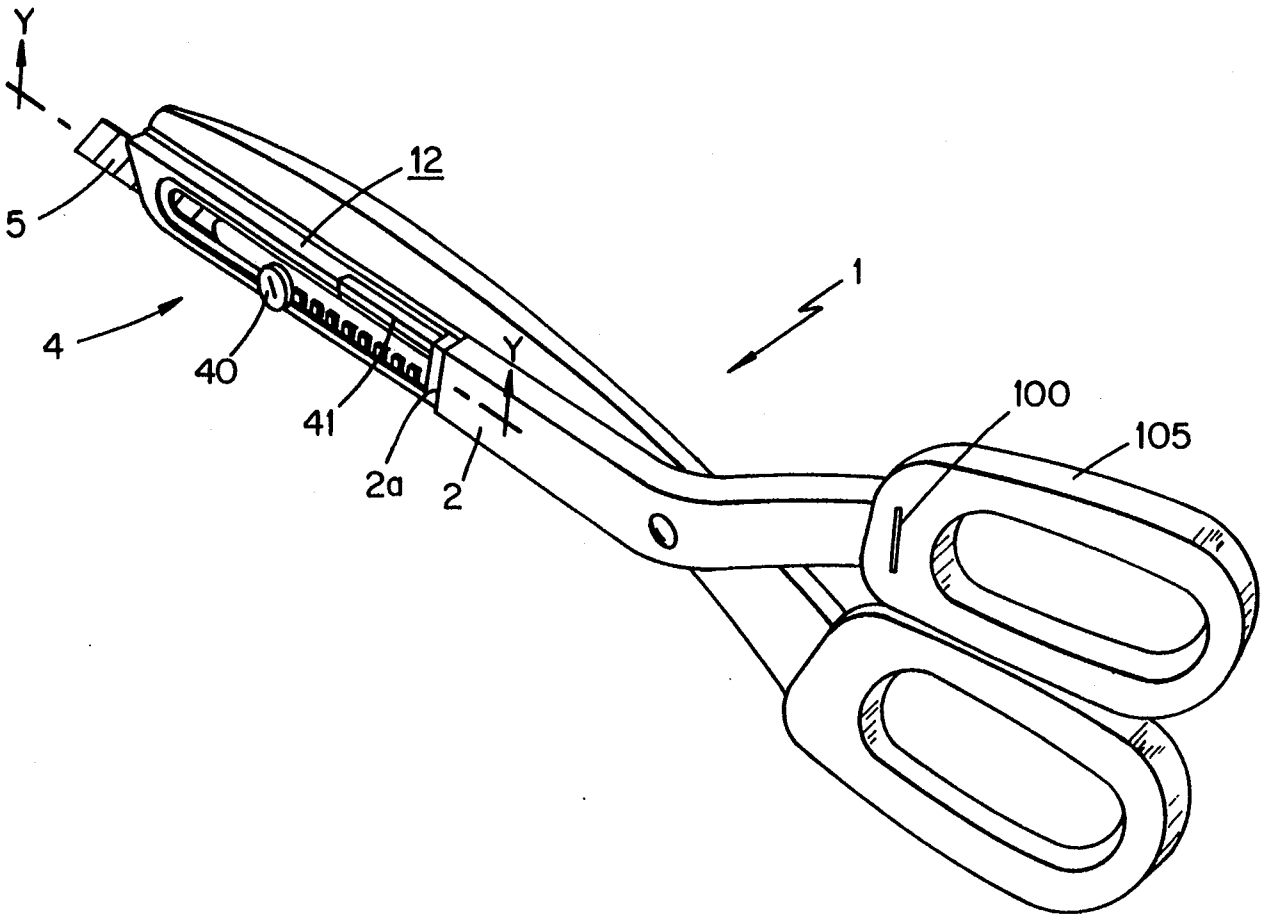
FIG. 7 is a perspective view showing the third embodiment of scissors combined with a cutter knife according to the present invention.
Figure 8:
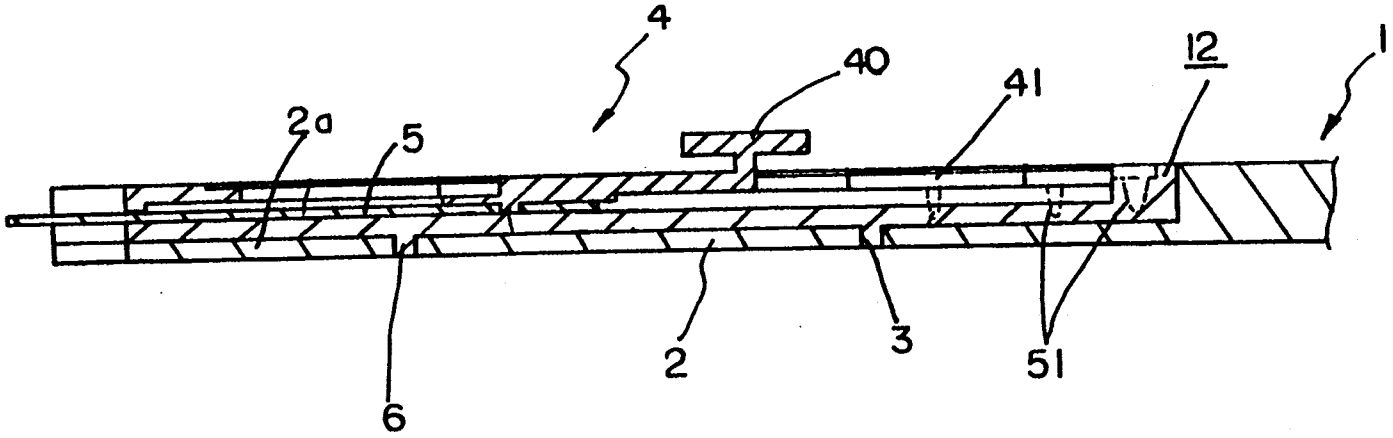
FIG. 8 is an enlarged cross-sectional view taken along the line Z-Z in FIG. 7.

FIG. 4 to FIG. 6 are views showing the second embodiment of scissors combined with a cutter knife according to the present invention.

As shown in the figures, the second embodiment according to the present invention is constituted with scissors 1 whose one blade 2 has two connection holes 3 and a cutter knife 4 whose back has two insertion protrusions 6.

The cutter knife 4 is a common one which allows a replacement of a blade 5 at the end of the cutter knife 4. In this case, there is no need to form a seat portion for the cutter knife on one blade of the scissors as in the first embodiment, so that easy manufacture of scissors combined with a cutter knife can be accomplished.

FIG. 7 to FIG. 9A, B, C are views showing the third embodiment of scissors combined with a cutter knife according to the present invention.

As shown in the figures and as in the first embodiment, the third embodiment is constructed by scissors 1 whose one blade 2 has a seat portion **2*a* and a cutter knife 4 whose blade 5 can be taken, for its replacement, out of the upper side at the end of the cutter knife 4. The knife case 12 of the cutter knife 4 has a concave portion 21 whose bottom has two connection holes 31 and a blocking member 41 which is detachable has two insertion protrusions 51 corresponding to the connection holes 31**.

As described in the first embodiment, the blade 5 and the slider **40*a* are housed in the knife case 12 after their connection through a hole 5*a* of the blade 5 and a protrusion (not shown) of the slider 40*a***.

And also, the blade 5 comes out of or into the knife case 12 when the slider knob 40 is pushed forwards or backwards.

Figure 9A:
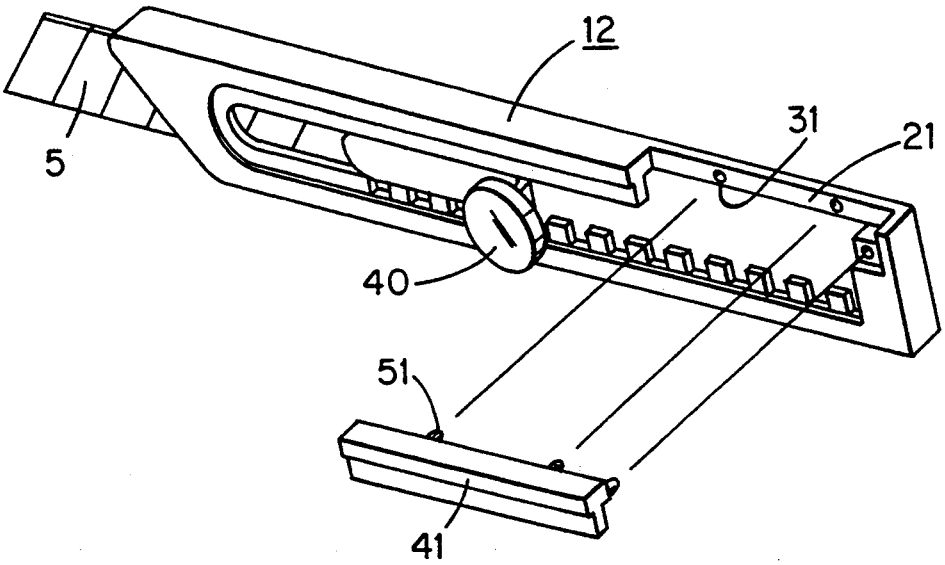
FIG. 9A to FIG. 9C are views for explaining replacement of the blade of a cutter knife in the third embodiment in FIG. 7.
Figure 9B:
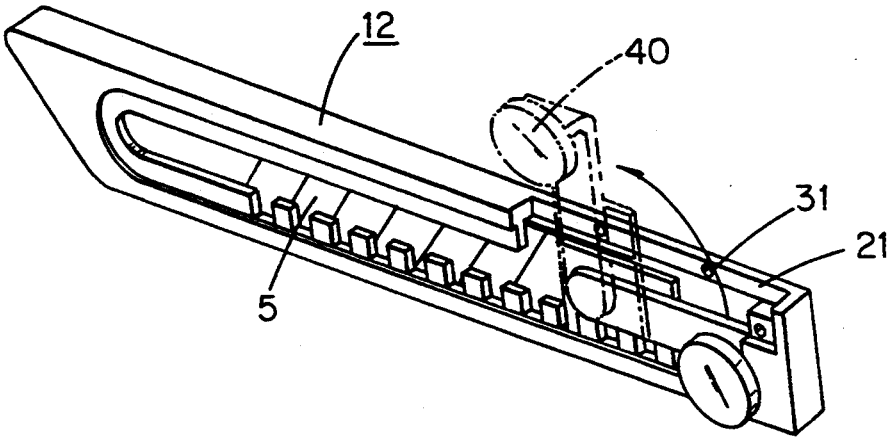
Figure 9C:
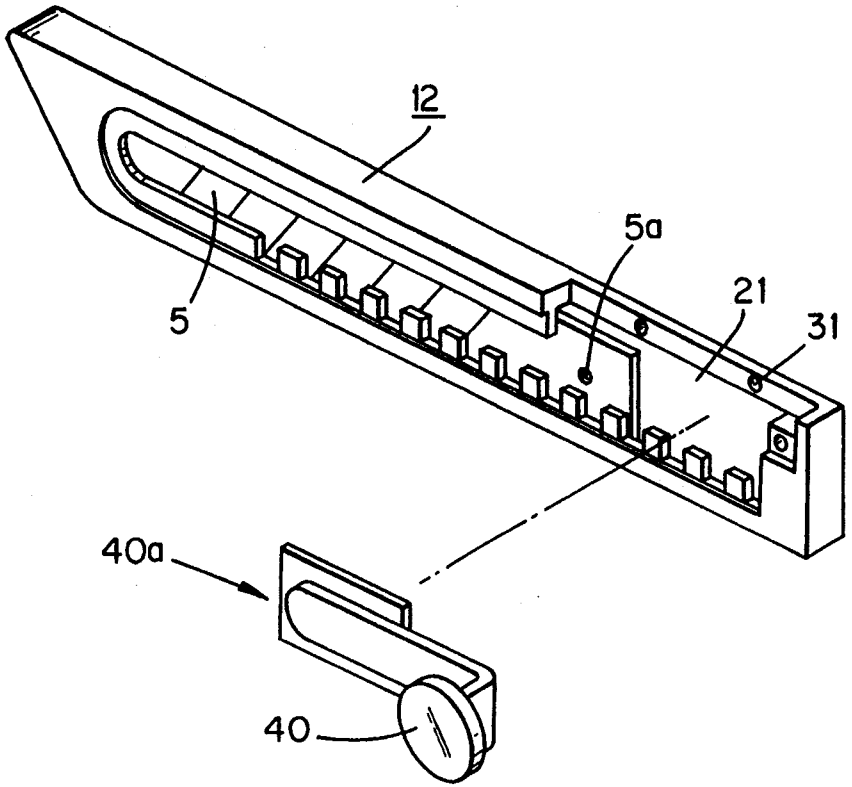

As shown in FIG. 9A and B, in case of replacing the blade 5 of the cutter knife 4, the blocking member 41 is removed from the knife case 12, the slider knob 40 is pushed to the end of the knife case 12 and then the slider **40*a* is taken out of the knife case 12. At this time, if the length of the blade 5 connected with the slider 40*a* is short, both of the blade 5 and the slider 40*a* can be taken out of the knife case 12. However, if the length of the blade 5 is long, the slider 40*a* is firstly taken out of the knife case 12 through the concave portion 21 after the slider 40*a* and the blade 5 have been disassembled, so that the blade 5 can be slided out of the knife case 12** slanted.

In the first, second and third embodiments according to the present invention, a blade insertion slit 100 for cutting a part of the blade 5 of the cutter knife 4 is formed on one of the holders 105 of the scissor 1, as shown in FIGS. 1, 4, 5 and 7, so that users can use a new part of the blade 5 by eliminating an old part of the blade 5.

As described aforementioned, scissors combined with a cutter knife according to the present invention can be conveniently used anywhere both scissors and a cutter knife are required, and an easy keeping is obtained for both of them since they are combined in one.

What is claimed is:

1. A combination scissors and cutting knife comprising:

a) a scissors having a pair of blades and blade holders; and b) a cutter knife attached to one of the blades of the scissors; the cutter knife further comprising:

i) an upper plate having a longitudinal slot therein, said slot terminating at an enlarged hole;

ii) a knife blade having a hole near an end thereof;

iii) a knife case having a pair of opposing upper plate fixing portions sized to receive said upper plate, a pair of opposing knife receiving walls extending from respective said upper plate fixing portions and being sized to receive said knife blade and a longitudinal toothed portion extending from one of said knife receiving walls;

iv) a slider having an elastic clicker, a guidance portion with a protrusion extending therefrom sized to engage the hole in the knife blade and a slider knob;

c) wherein the slider moves along the longitudinal toothed portion by movement of the slide knob and the elastic clicker, the knife blade being locked in a given position by the elastic clicker engaging a tooth of the longitudinal toothed portion.

2. The combination scissors and cutting knife of claim 1, wherein the cutter knife is attached to the one blade by at least one protusion on the cutter knife and at least one connection hole on the one blade.

3. The combination scissors and cutter knife of claim 1, wherein one of said blade holders has a slit therein for receiving a cutting a part of the knife blade.

4. A scissors and cutter knife combination comprising:

a) a scissors having a pair of blades and blade holders;

b) a cutter knife attached to one of the blades of the scissors, the cutter knife further comprising:

i) a knife blade having a slider attached to an end thereof;

ii) a knife case sized to receive the knife blade and slider and to permit longitudinal movement of the knife blade and slider therein, the knife case having a recessed portion and a blocking member removably attached into said recessed portion;

c) wherein said knife blade and slider can be removed from the knife case by removal of the blocking member from the recessed portion.

5. The combination scissors and cutter knife of claim 4, wherein the cutter knife is attached to the one blade by at least one protusion on the cutter knife and at least one connection hole on the one blade.

6. The combination scissors and cutter knife of claim 4, wherein one of said blade holders has a slit therein for receiving and cutting a part of the knife blade.

7. The combination scissors and cutter knife of claim 4, wherein the recessed portion has at least one hole therein and the blocking member has a protrusion extending therefrom, the hole sized to receive the protrusion for removable attachment of said blocking member in the recessed portion.

* * * * *